United States Patent [19]

Hellickson

[11] Patent Number: 5,020,159

[45] Date of Patent: Jun. 4, 1991

[54] PROTECTIVE ARTICLE FOR HANDLING AND CONTAINING WASTE MATERIALS

[75] Inventor: Harold M. Hellickson, Atlanta, Ga.

[73] Assignee: Delyle, Inc., Etowah, N.C.

[21] Appl. No.: 353,863

[22] Filed: May 17, 1989

[51] Int. Cl.[5] ..... A41D 19/00

[52] U.S. Cl. ..... 2/158; 2/161 R; 2/167; 2/168

[58] Field of Search ..... 2/162, 168, 158, 161 R, 2/167; 15/227; 206/438, 363, 361

[56] References Cited

U.S. PATENT DOCUMENTS

| | | | |
|---|---|---|---|
| 2,106,348 | 1/1938 | Hall et al. | 2/168 |
| 2,641,767 | 6/1953 | La Rosa | 2/168 |
| 2,821,718 | 2/1958 | Hall et al. | 2/162 |
| 3,225,360 | 12/1965 | Keilen, Jr. et al. | 2/167 |
| 3,596,798 | 8/1971 | Smith | 221/56 |
| 3,739,418 | 6/1973 | Yonaites et al. | 15/104.8 |
| 3,813,121 | 5/1974 | Marvin | 294/1 R |
| 3,850,467 | 11/1974 | Johnson | 294/1 R |
| 4,034,854 | 7/1977 | Smith | 206/278 |
| 4,186,445 | 2/1980 | Stager | 2/164 |
| 4,215,886 | 8/1980 | Naderi et al. | 294/1 B |
| 4,469,258 | 9/1984 | Wright et al. | 206/631 |
| 4,645,251 | 2/1987 | Jacobs | 294/1.3 |
| 4,677,697 | 7/1987 | Hayes | 2/159 |
| 4,768,818 | 9/1988 | Kolic | 294/1.3 |
| 4,788,733 | 12/1988 | Lerner | 15/104.94 |
| 4,845,781 | 7/1989 | Strickland et al. | 2/161 |
| 4,902,283 | 2/1990 | Roijko et al. | 2/167 |

FOREIGN PATENT DOCUMENTS

| | | |
|---|---|---|
| 2333482 | 7/1977 | France . |
| 2530940 | 2/1984 | France . |
| 8402640 | 7/1984 | France . |

OTHER PUBLICATIONS

Promotiional Literature for Glouch TM , Glove.

*Primary Examiner*—William A. Cuchlinski, Jr.
*Assistant Examiner*—Daniel G. DePumpo
*Attorney, Agent, or Firm*—Troutman, Sanders, Lockerman & Ashmore

[57] ABSTRACT

An article for safely handling and enclosing waste material is disclosed. The article includes a flexible glove member which is large enough for convenient insertion and removal of a human hand through an access opening. A continuous collar surrounds the access opening. A sealing strip is provided either on or adjacent the collar. To use the article, the user inserts a hand in the glove member and firmly grasps the waste material. The waste material is then pulled through the collar, thereby turning the article inside out to form a pouch enclosing the waste material. Finally, the sealing strip is utilized to seal the pouch, thereby creating a safe enclosure for disposal of the waste material.

19 Claims, 4 Drawing Sheets

PROTECTIVE ARTICLE FOR HANDLING AND CONTAINING WASTE MATERIALS

BACKGROUND OF THE INVENTION

1. Field of the Invention.

The invention relates to articles such as gloves or pouches for handling and enclosing waste and, more particularly, to an article for handling and enclosing waste materials which may be noxious or infectious in a manner which poses a minimal possibility of the user coming in contact with either the waste materials or with portions of the waste handling article which have been in contact with the waste materials.

2. Description of the Prior Art.

A critical need has arisen in recent years for providing means for handling waste materials which may have been in contact with or contain human blood or other bodily fluids. It is important that means be provided for handling and containing such waste materials for disposal with minimum risk of the waste coming into direct contact with a human being in order to prevent the spread of diseases which may be transmitted via bodily fluids.

A number of waste-handling articles have been proposed in which a glove or mitt-like article is first used to pick up the waste and then is "everted" (turned inside out) to enclose the waste. These waste handling articles may then be tied up or sealed in some manner to provide a container for disposal of the waste. Examples of such waste handling articles may be found, for example, in U.S. Pat. Nos. 4,186,445; 4,768,818; 3,596,798; 4,034,853; 4,788,733; and 4,677,697. None of these waste handling articles are, however, specifically adapted for the handling of waste materials which have the possibility of being highly noxious or infectious. Consequently, the use of these prior art waste handling articles is believed to present some risk that the user will either come in contact with the waste material or those fluids contained in the waste material may leak from the waste handling article after containment.

A waste handling article which has been designed particularly for the handling and disposal of waste materials containing bodily fluids or the like is a combination glove/pouch made of a plastic material which has a pair of opposing tabs at its opening. These tabs are made of boardstock to which the glove is attached. Adhesive material, protected by a paper strip, is deposited on one of the glove/tab surfaces. In operation, one of the user's hands is put inside the waste handling article through its opening. The contaminated waste is then grasped by this covered hand. Next the hand is withdrawn through the opening past the tabs thereby turning the article inside out. Finally, the paper strip is removed from the adhesive and the adhesive coated tab is pressed against the uncoated glove/tab to seal the contaminated article inside the pouch which has been formed by turning the glove inside out. This prior art waste handling article is illustrated in FIG. 1. It will be noted from FIG. 1 that the edges 2 and 2' of the tabs 1 of the article must be separated so as to allow the adhesive coated side of the tab to flip 180 degrees around connecting hinges 4 and 4'. This allows the tabs to become positioned inside of the pouch created when the glove portion 3 of the article is turned inside out. Several problems may be caused by this configuration. Firstly, because the two tabs are separated by openings they may have a tendency to flip into an unwanted state and to be generally unwieldy during operation of the waste handling article. Secondly, the two tabs are only minimally connected by hinges. This makes it relatively easy to misallign the strips of adhesive strip when the glove is everted. Non-alignment of this adhesive strip may result in improper sealing of the pouch, especially in the region of the edges 2 and 2' of the tabs 1.

It is an object of the present invention, therefore to provide a waste handling article which may be conveniently used to handle waste materials and to contain these materials in a protective pouch for disposal without exposing the user to direct contact to the waste materials or any contaminated surface.

It is a further object of the invention that means be provided for sealing the pouch which prevents any fluids contained in the waste materials from leaking from the pouch after sealing.

It is a further object of the invention that the above article be relatively inexpensive and simple to manufacture.

It is yet a further object of the invention that the above article be easy to use.

SUMMARY OF THE INVENTION

In fulfillment of the above and other objectives, the present invention provides a combined waste handling glove/disposable pouch which is formed of a strong and flexible material such as ethyl methyl acrylate copolymer film. The article is, preferably, formed in a glove or mitten-like shape which is large enough to be conveniently used by most people. Preferably, the glove is sufficiently long so as to cover the entire forearm and elbow of the user. The opening of the glove is surrounded by a continuous collar. The continuous nature of this collar has a number of advantages. Firstly, it alleviates the alignment problems associated with an article having two opposed sealing tabs. Secondly, the problem of a sealing tabs' tendency to flip about is eliminated. Finally, it is believed that this single continuous collar may be more economically produced than the two-tabbed alternative of the prior art.

In accordance with the invention, a sealing means may be incorporated on one or both outside surfaces of the glove including the edges of the glove either on the collar, or directly below it. This sealing means may, for example, be either a strip of cohesive (preferably pressure sensitive) material or a strip of adhesive material with a removable covering. The removable covering may, for example, be a strip of silicone treated paper.

The continuous collar may be formed from either a relatively stiff material such as high density polyethylene ("HDPE") or boardstock or a heavy basis weight paper (e.g. 80 lbs.). Alternatively, a relatively soft and flexible material such as polyurethane foam, low density polyethylene foam, or a light basis weight paper (e.g. 30 lbs.) may be used. Finally, the functions of the collar and the material covering the adhesive strip may be combined so that when this covering is removed the collar is also removed and a sealed pouch may be formed which has no collar whatsoever.

In an embodiment of the invention utilizing the stiff collar, a strip of adhesive material covered by a protective strip is formed in the shape of a ring directly below the collar of the glove. To operate this embodiment the hand of the user is placed inside the glove and this covered hand picks up the waste material. The other hand is placed inside the collar. The hand holding the waste material is then pulled through the protective ring and the collar, thereby "everting" the glove (turning it inside out) and forming a pouch containing the waste material. The eversion process is interrupted at the edge of the protective strip. This protective strip is then removed from the adhesive and the eversion of the glove proceeds to the edge of the collar. At this point, the adhesive coated surfaces of the glove have been moved to opposing positions inside the collar. A seal is then formed by applying pressure to the outside surfaces of the collar thereby pressing the adhesive coated surfaces together.

In an embodiment of the invention utilizing a soft collar, an adhesive material may be deposited on the outside of the collar itself. When the glove is everted the softness and flexibility of the collar allows it to be everted as well. This places the adhesive coated surfaces of the collar into opposed inside positions. Thus, when the collar is compressed an effective seal may be formed.

Finally, in the embodiment of the invention in which the protective strip covering the adhesive forms the collar, the glove is everted until this eversion reaches the edge of the protective strip. The strip is then removed and, in one motion, the user completes the eversion and crimps the opening of the glove together.

The above and other objects and advantages of the invention will become apparent with reference to the following drawings.

DETAILED DESCRIPTION

Figure 1:
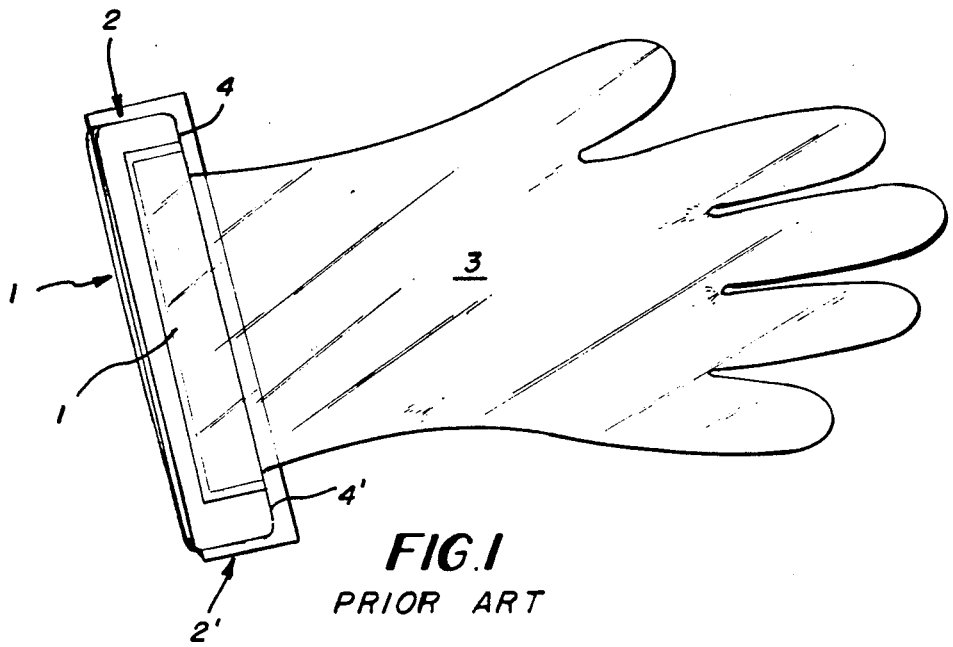
FIG. 1 PRIOR ART
FIG. 1 is a perspective view of a prior art article for handling waste materials.
Figure 2:
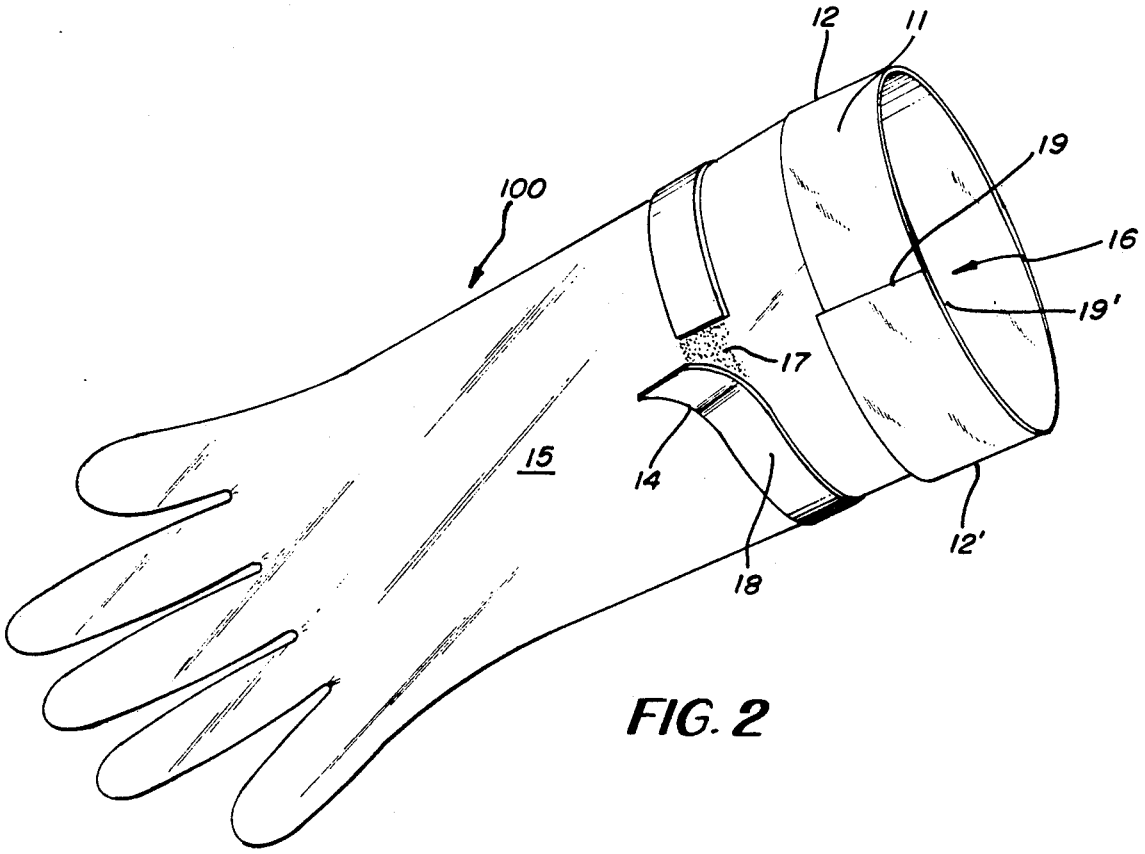
FIG. 2 is a perspective view of an embodiment of the present invention with a protective strip of paper covering a sealing adhesive shown being partially removed.

Referring to FIG. 2, there is shown an embodiment 100 of the invention which includes a glove member 15, a continuous collar 11, which is attached to the glove member 15 adjacent its opening 16, and sealing means 14 which is on the outside surface of the glove member 15 just below the collar 11. In the embodiment illustrated by FIG. 2 this sealing means 14 is a strip of adhesive material 17 covered by a removable strip of protective covering 18. Sealing means 14 and protective covering 18 should, preferably, extend around both glove edges 12 and 12' and cover a portion of the opposite glove side but need not be a continuous ring of adhesive as shown.

The glove member 15 is formed of a film of plastic having the characteristics of strength, resistance to puncture and flexibility. This material may be a plastic such as polyethylene, but, in a preferred embodiment an ethyl methyl acrylate ("EMA") copolymer film is utilized. This EMA film is softer and easier sealing, and has lower flexural modulus and greater elongation than does polyethylene. Such EMA material is commercially available and is presently used, for example, to form examination gloves. Unlike an examination glove, however, the glove member 15 of the present invention must be formed large enough to fit any hand within a normal range of hand sizes and be loose enough to allow easy insertion for removal of the hand from the glove member 15. Preferably, glove member 15 should also be sufficiently long to provide arm protection for the user as well as containment of the waste material.

When donned by the user, the glove member 15 should, preferably extend to a point just above the elbow. Thus, the length of the glove member 15 from the tip of its finger portions to its opening 16 should be in the range of 20 to 26 inches so as to properly fit most users. In a presently preferred embodiment the length of the glove member 15 is 23 inches. The opening 16 of the glove member 15 should be large enough for easy insertion of a hand and removal of the hand through the collar 11 while the hand is grasping waste material (see FIGS. 3 and 4). Thus, the distance between the edges 12 and 12' of the collar 11 when the glove and collar are flattened should be in a range of 7.5 to 10 inches (resulting in a circumference of the opening 16 of the glove member 15 being in the range of 15 to 20 inches). In a presently preferred embodiment the opening is 17 inches in circumference.

The materials used to form the collar 11 and the sealing means 14 should be compatible with the material used to form the glove member 15. In this regard, the collar 11 should be formed of a material which can be fused or otherwise joined to the glove member 15, and the sealing means 14 should be a medium which is capable of sealing layers of the material forming the glove member 15 to each other.

In the embodiment shown in FIG. 2, the collar 11 is formed of a ring of high density polyethylene ("HDPE") about 10 mils (thousandths of an inch) in thickness. A continuous ring of the appropriate circumference may be formed by overlapping the end portions 19 and 19' of a strip of such HDPE which is 1 to 2 inches in width. The joining of the end portions 19 and 19' may be accomplished, for example, by heat-sealing them together. The ring may then be flattened to form a tight oval conforming to the open end 16 of a "flat" glove made of ethyl methyl acrylate (EMA) copolymer film. HDPE and EMA have been found to be heat seal compatible and the two components may, therefore, be joined by heat sealing, although other methods of sealing will be apparent to those skilled in the art.

This "continuous" collar 11 may be attached either to the inside surface or outside surface of the glove member 15. In the alternative, low density polyethylene ("LDPE") about one-eighth inch in thickness has been found to be an appropriate material for forming the stiff collar 11. Other types of relatively stiff plastic or of other stiff materials such as paper board stock, cardboard, or heavy paper may also be appropriate materials for forming the stiff collar 11. Moreover, heat sealing is not the only means which may be employed for affixing the continuous stiff collar 11 to the glove member 15. Similar results may be obtained by using an adhesive to attach the collar 11 to the glove member 15. Such adhesive attachment may be particularly advantageous where the collar is formed of polyurethane foam approximately one-eighth inch in thickness or from heavy basis weight paper of approximately 80 pounds in basis weight.

A number of alternatives are available for implementing the sealing means 14. A "cohesive" material which will form a seal only when it contacts another layer of a similar material may be used. Such cohesive materials are available commercially and are used, for example, as sealing means for mailing envelopes. Alternatively, a two-sided adhesive tape covered by a protective strip of silicone release paper may be used. In this embodiment the silicone release paper must be removed from the adhesive before sealing of the article 100 can be accomplished. In one preferred embodiment commercially available pressure sensitive hot melt adhesive material is used. Using this approach, the adhesive material is adhered to the glove member 15. The adhesive is covered by a protective covering strip of silicone release paper.

Figure 3:
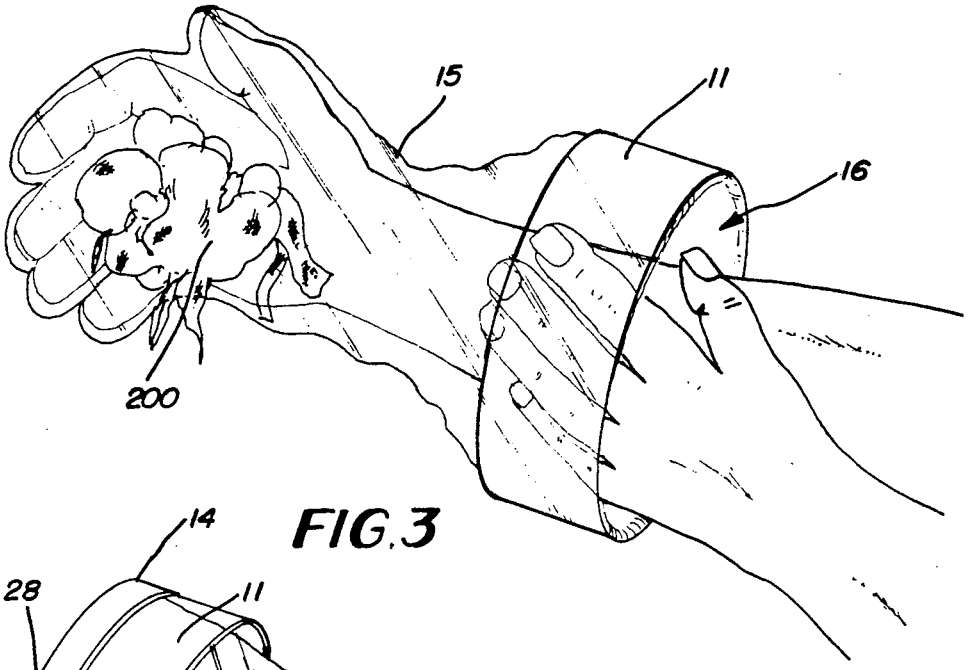
FIG. 3 is an illustration of the present invention with the user's right hand shown grasping the waste material and beginning to bring it back through the opening thereof thereby everting the glove. The free hand is shown inserted into the opening of the glove.
Figure 4:
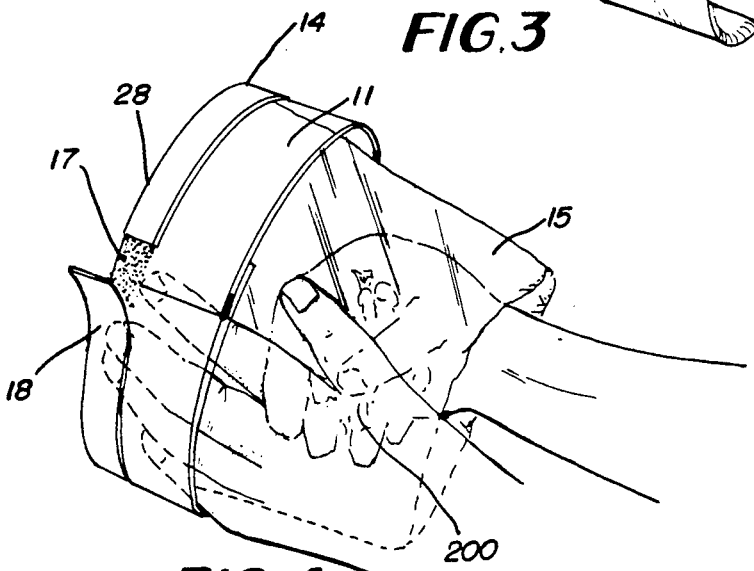
FIG. 4 is a view of the invention in which the working hand is gripping the waste material and the eversion of the glove is nearly complete.
Figure 5:
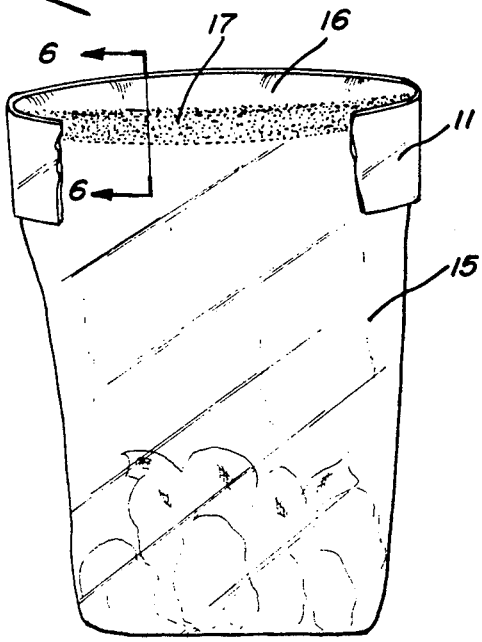
FIG. 5 shows a step in which the working hand has been removed from the glove and the seal has been made by pressing two sides of the glove together.

Use of the article 100 of FIG. 2 is illustrated in FIGS. 3, 4 and 5. Referring to FIG. 5, the user first places one hand (the "working hand") inside the glove member 15 through its opening 16. Waste material 200 is then grasped firmly by the working hand and this waste material 200 is brought through the opening 16 thereby everting (turning inside out) the glove member 15 to form a pouch covering the waste material 200 and isolating it from contact with the user (see FIG. 4). As shown in FIG. 3 it may be convenient for the user to place his or her "free hand" inside the opening 16 of the glove member 15 while this eversion is being accomplished, both to facilitate the eversion process, and to ensure that the free hand does not inadvertently come in contact with the waste material 200 before the waste material is completely enclosed within the everted glove member 15.

Figure 6:
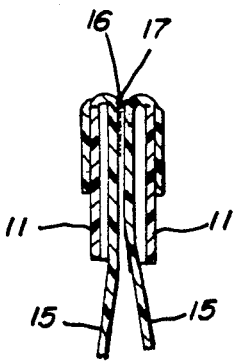
FIG. 6 is a section taken along line 6—6 of FIG. 5 showing how the two sides of the glove appear after being pressed together.

Referring to FIG. 4, where the sealing means 14 is a strip of adhesive material 17 covered by paper 18, eversion of the glove member 15 is continued until it reaches the bottom edge 28 of the sealing means 14. The working hand is then removed from the everted glove and removes the protective strip of material 18 from the adhesive 17. The working hand then grasps the outside of the pouch and eversion is continued so that the strip of adhesive 17 reaches a position inside the collar 11 (see FIG. 5). The collar 11 may then be compressed thereby sealing the open end 16 of the pouch formed by the glove member 15 which surrounds the waste material 200 as illustrated by FIG. 6.

In the case of use of a cohesive material, which does not require protective covering 18 which must be removed prior to sealing, the process of eversion can be completed in one step, by bringing the cohesive material 17 to a position inside the collar 11 in one motion. Compression of the collar then presses the two layers of cohesive material together forming a seal of the pouch enclosing the waste material 200.

Figure 7:
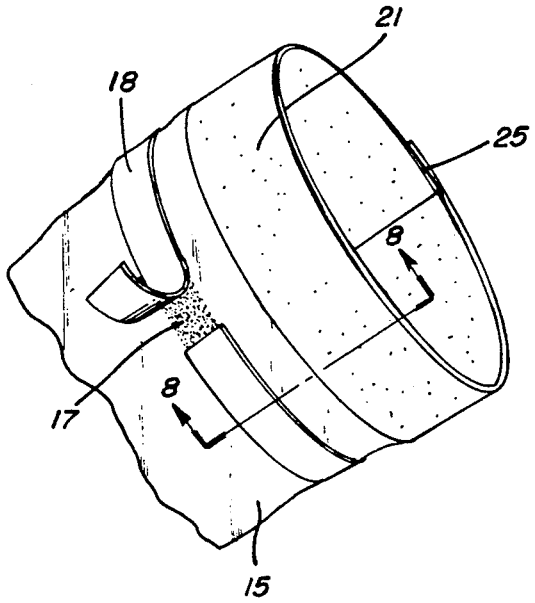
FIG. 7 is an embodiment of the present invention in which the collar of the glove is made of a soft material.
Figure 8:
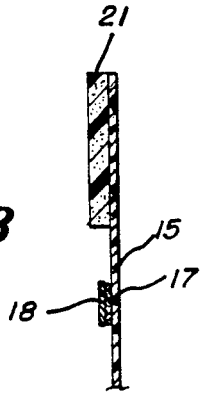
FIG. 8 is a section taken along line 8—8 of FIG. 7 which shows how the glove of film plastic is bonded to the soft collar and the adhesive strip with the paper protective strip is still intact.

FIGS. 7 and 8 show another embodiment of the invention having a collar 21 which is formed of a relatively soft and flexible material such as polyurethane foam or low density polyethylene foam. This embodiment offers an added degree of safety of use since, in the eversion process the collar itself may also be everted because of its flexibility. Thus, after eversion of the glove member 15 is completed, all surfaces of the glove member 15 facing the outside are surfaces which were originally on the inside of the glove member 15 prior to eversion. Use of this embodiment is, otherwise, similar to use of embodiment of FIGS. 2 through 6 discussed above.

Figure 9:
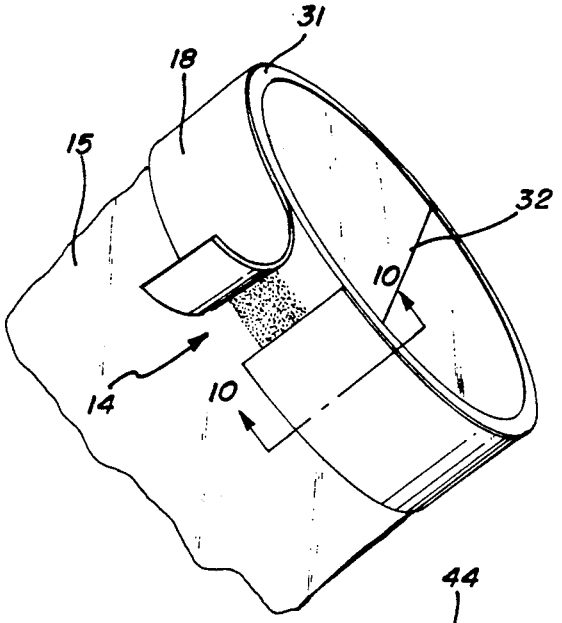
FIG. 9 illustrates an embodiment of the present invention in which the sealing medium is placed directly on the collar.
Figure 10:
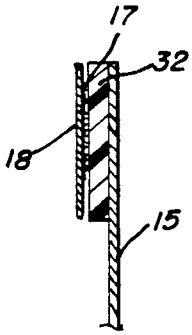
FIG. 10 is a section taken along line 10—10 of FIG. 9 showing how the film-like material is attached to the inside of the collar, and the adhesive is placed on the outside with a paper protective covering.

FIGS. 9 and 10 show yet another embodiment of the invention. In this embodiment a soft collar 31 is employed which is similar in construction to the soft collar 21 of FIGS. 7 and 8 which is described above. In the embodiment of FIGS. 9 and 10, however, the sealing means 14 is placed directly on the collar 31. Since the soft construction of the collar 31 allows it to be everted when the waste material is pulled through the opening of the collar, the sealing means 14 will be on the inside of the collar 31 after eversion of the glove member 15 is completed. At this time the protective covering 18 (if any) of the adhesive 17 may be removed and sealing of the pouch enclosing the waste material may be completed by applying pressure to the outside (originally inside) surfaces of the collar 31. It will be noted that in this embodiment the collar 31 is formed with a butt joint 32 rather than an overlapping of end portions 25 as in the embodiment of FIGS. 7 and 8. Such butt joint construction, while it may also be used in the FIGS. 7 and 8 embodiment, is especially useful in the FIGS. 9 and 10 embodiment. This is because where the adhesive 17 is coated directly on the collar 32, there would be a tendency for a seal to leak at the point of overlap of end portions of the collar. Formation of the collar with a butt joint 32 in place of such an overlap helps, therefore, to prevent the possibility of leakage through the seal.

Figure 12:
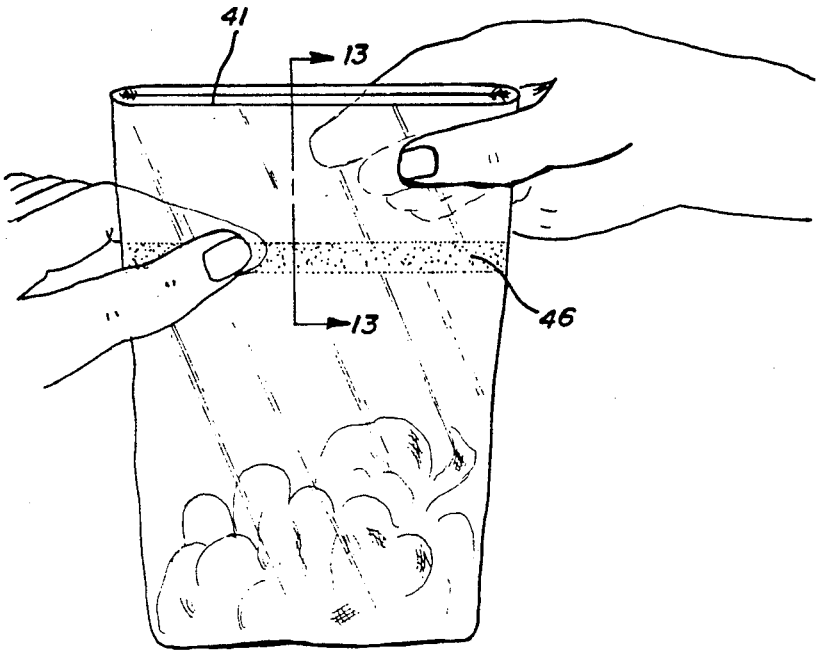
FIG. 12 is a perspective view of the embodiment of the present invention using two sealing media, and showing how the waste material is sealed in by wiping across the adhesive with the fingers; the free hand across the bottom seal, and the right hand across the top one.
Figure 13:
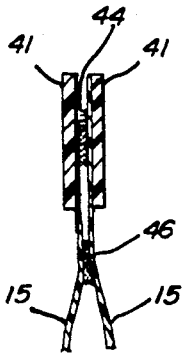
FIG. 13 is a section taken along line 13—13 of FIG. 12 showing how the two sides of the film material are brought together thereby making the bottom seal, and the soft collar is pressed together to form the top seal.
Figure 11:
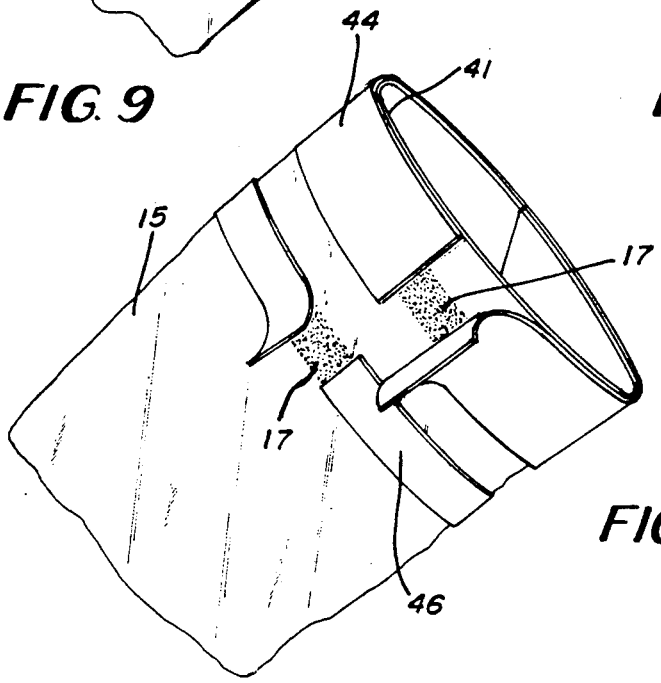
FIG. 11 illustrates an embodiment of the present invention which utilizes two sealing media.

FIG. 11 illustrates yet another embodiment of the invention combining the sealing methods of FIGS. 7 and 8 and of FIGS. 9 and 10. Thus in FIG. 11 there are two sealing means. A first sealing means 44 is placed directly over a soft collar 41 and a second sealing means 46 is placed directly below the collar 41. Referring to FIGS. 12 and 13 the glove member 15 of the FIG. 11 embodiment is everted until the sealing means 46 has been uncovered (if necessary) and everted. The pouch is then sealed by compressing the layers of sealing means 46 together. Eversion is then completed by everting the collar 41 and uncovering (if necessary) the adhesive material of the sealing means 44. A second seal is then provided by compressing the collar 41.

Figure 14:
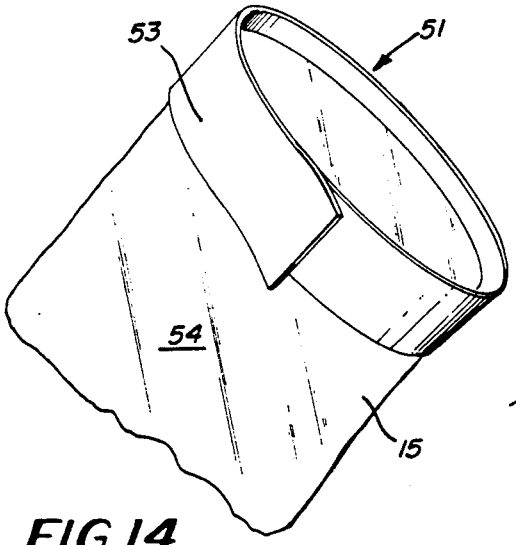
FIG. 14 shows yet another embodiment of the present invention in which adhesive is applied directly to the film material and covered with a paper protective strip.
Figure 15:
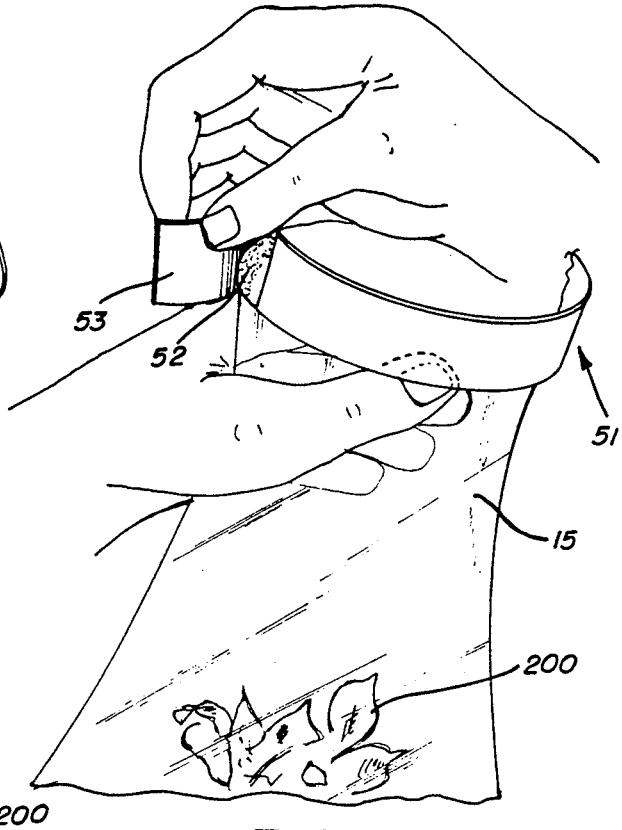
FIG. 15 is a view of the embodiment of FIG. 14 showing the free hand beneath the sealing ring after eversion is nearly complete. The working hand now freed from the glove is removing the protective paper thereby exposing the adhesive.
Figure 16:
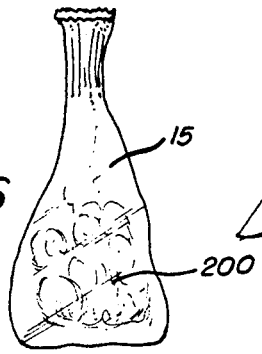
FIG. 16 is a perspective view of the embodiment of FIG. 14 now fully everted in the pouch condition and with the top twisted and crimped so as to have the adhesive form a complete seal.

FIGS. 14–16 illustrate yet another embodiment of the present invention in which the functions of the collar and of the sealing means are provided by a single component. As shown in this figure a collar 51 of the article is formed by a sealing means which comprises a strip of adhesive material 52 covered by a protective covering 53 formed of a material such as silicone coated paper. This protective covering 53 is sufficiently long so that an uncoated tab 54 may be provided at one end of the strip 53. To use the article, the working hand of the user is inserted inside the glove member 15 and firmly grasps the waste material 200. The free hand is inserted under the collar 51 through the glove opening to control the glove during eversion. The working hand is then brought through the opening of the collar 51 thereby everting the glove member 15 until this eversion reaches the bottom edge of the collar 51. The working hand is then removed from the glove and grasps the tab 53 to pull the protective covering away from the adhesive material which remains adhered to the glove member 15 (see FIG. 15). During this operation the collar 51 remains draped over the free hand. The free hand is then used to grasp an outside surface of the glove member 15 near the collar 51 (formerly the inside surface before it was everted to form the pouch) and the working hand grasps the pouch just below the free hand. The free hand then forms a ring with its thumb and index finger and is slid towards the open end of the glove thereby completing the eversion and crimping the exposed adhesive coated surfaces of the glove member 15 together (see FIG. 16). Further sealing may be accomplished by finger manipulation of the formerly open end of the glove so as to further crimp the adhesive coated surfaces together.

I claim:

1. An article for safely enclosing waste material comprising:

a flexible glove member having an access opening through which a hand of a human being is inserted when putting on said glove member;

a relatively inflexible eversion-resistant continuous collar surrounding the access opening whereby when waste held by the hand covered by the glove member is pulled through the collar and the hand removed from the glove member the glove member is thereby everted to form a pouch enclosing the waste material and said collar remains in an uneverted position; and means in the proximity of the collar for sealing the pouch created by eversion of the glove member.

2. The article of claim 1 wherein said glove member is in the range of 20 to 26 inches in length.

3. The article of claim 1 wherein said circumference of said access opening is in the range of 15 to 20 inches.

4. The article of claim 1 wherein said glove member is formed of a polyethylene film.

5. The article of claim 1 wherein said glove member is formed of an ethyl methyl acrylate (EMA) copolymer film.

6. The article of claim 1 wherein said sealing means comprises a strip of cohesive material having an axis parallel to an edge of the glove member forming the access opening and substantially longitudinally coextensive with more than half of said edge.

7. The article of claim 1 wherein said sealing means comprises a strip of pressure sensitive adhesive material.

8. The article of claim 1 wherein said sealing means comprises a strip of silicone coated material further coated on one side thereof with a layer of adhesive material said strip being affixed to an outside surface of said glove member on an axis substantially parallel to a longitudinal axis of said collar with said adhesive layer positioned between the outside surface of said glove member and said silicone coated material.

9. The article of claim 8 wherein said silicone coated material is a silicone coated paper stock.

10. The article of claim 8 wherein said color is formed of a relatively rigid material.

11. The article of claim 10 wherein said strip extends more than half-way around the glove member and is positioned adjacent said collar.

12. The article of claim 10 wherein said collar is formed of paper.

13. The article of claim 10 wherein said collar is formed of a board stock material.

14. The article of claim 10 wherein said collar is formed of a plastic material.

15. The article of claim 14 wherein said collar is formed of high density polyethylene.

16. The article of claim 1 wherein said collar is formed of a material selected from the group consisting of polyurethane foam and low density polyethylene foam.

17. The article of claim 1 wherein said sealing means comprises a strip of pressure sensitive adhesive material positioned adjacent to said collar.

18. The article of claim 1 wherein said sealing means comprises a strip of pressure sensitive adhesive material positioned adjacent said collar and extending more than half-way around the glove member.

19. The article of claim 1 wherein said collar comprises a removable strip of silicone treated material having an adhesive coated portion on one side thereof and a tab portion at one end of said strip with no adhesive coating, said adhesive coated portion being substantially equal in length to an edge portion of the glove member forming the access opening, said strip being affixed to an outside surface of the glove member adjacent said edge portion.

* * * * *